US007682055B2

(12) United States Patent
Shuai et al.

(10) Patent No.: US 7,682,055 B2
(45) Date of Patent: Mar. 23, 2010

(54) LED LAMP

(75) Inventors: Chun-Jiang Shuai, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/184,260

(22) Filed: Aug. 1, 2008

(65) Prior Publication Data

US 2010/0027262 A1 Feb. 4, 2010

(51) Int. Cl.
*F21V 29/00* (2006.01)

(52) U.S. Cl. ..... 362/373; 362/294; 362/249.02; 362/800; 362/547; 362/545

(58) Field of Classification Search ..... 362/545, 362/547, 800, 249.02, 294, 373
See application file for complete search history.

(56) References Cited

U.S. PATENT DOCUMENTS

| | | | | |
|---|---|---|---|---|
| 7,329,030 | B1 * | 2/2008 | Wang et al. | 362/373 |
| 2007/0285926 | A1 * | 12/2007 | Maxik | 362/294 |
| 2008/0117637 | A1 * | 5/2008 | Chang et al. | 362/294 |

* cited by examiner

*Primary Examiner*—Laura Tso
(74) *Attorney, Agent, or Firm*—Frank R. Niranjan

(57) ABSTRACT

An LED lamp includes a bracket and a heat sink mounted on a top side of the bracket. The heat sink includes a base. A plurality of LED module assemblies is mounted to a bottom surface of the base of the heat sink. Each of the LED module assemblies includes a heat absorbing plate located below the bottom surface of the base of the heat sink, an LED module mounted on a bottom surface of the heat absorbing plate and a heat pipe interconnecting the bottom surface of the base and a top surface of the heat absorbing plate. The heat pipes are U-shaped and horizontally positioned and have different heights.

18 Claims, 4 Drawing Sheets

LED LAMP

BACKGROUND OF THE INVENTION

1. Field of the Invention

The present invention relates to an LED lamp, and more particularly to an LED lamp incorporating heat pipes for improving heat dissipation of the LED lamp.

2. Description of Related Art

Conventionally, an LED lamp comprises a heat sink and a plurality of LEDs mounted on a bottom surface of the heat sink. The LEDs are arranged in a plurality of lines along a longitudinal direction of the heat sink. When the LEDs are activated to light, heat generated by the LEDs is dispersed to ambient air by natural air convection via the heat sink.

However, in order to achieve a compact design and facilitate a convenient transportation and handling of the LED lamp, the LED lamp has a small size. The LEDs are assembled on a small area. Thus, heat generated by the LEDs are accumulated on the heat sink and leads to the LEDs overheating, whereby the LEDs will operate unstably or even fail.

What is needed, therefore, is an LED lamp having a good heat dissipation efficiency.

SUMMARY OF THE INVENTION

An LED lamp includes a bracket, a heat sink mounted on a top side of the bracket and a plurality of heat conductive plates attached to a bottom surface of the heat sink. The heat sink includes a base, and a plurality of LED module assemblies mounted below the base of the heat sink. Each of the LED module assemblies includes a heat absorbing plate located below a bottom side of the base of the heat sink, an LED module mounted on a bottom surface of the heat absorbing plate and a heat pipe interconnecting a bottom surface of the heat conductive plate and a top surface of the heat absorbing plate. The heat pipes have different heights. The LED modules are oriented toward different directions.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
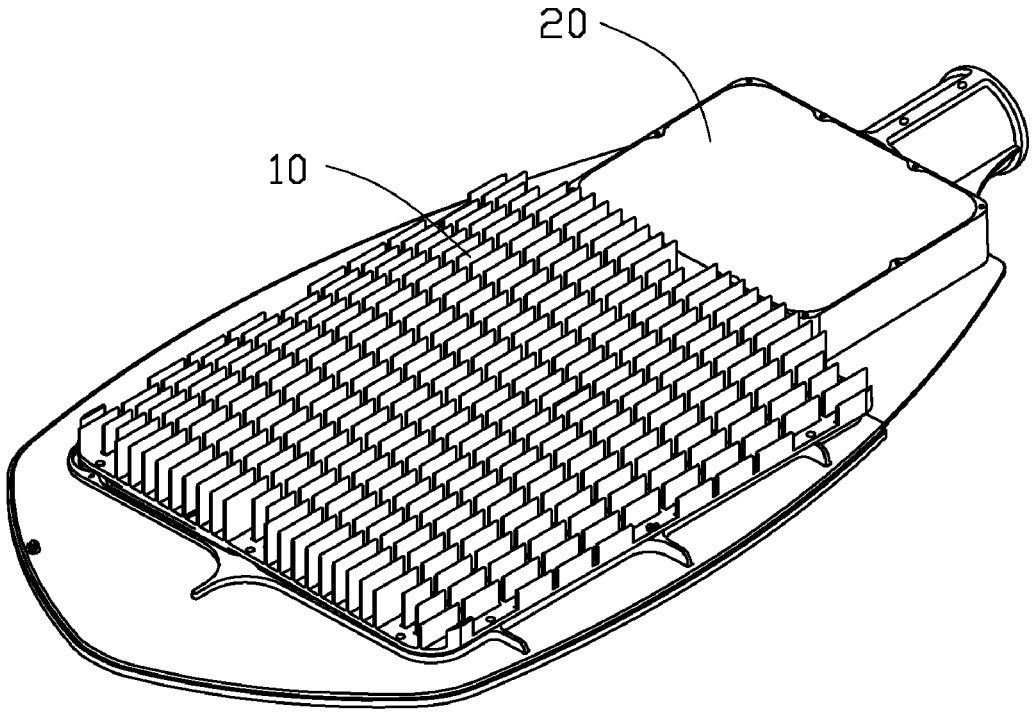
FIG. 1 is an assembled view of an LED lamp assembly in accordance with a preferred embodiment of the present invention.
Figure 2:
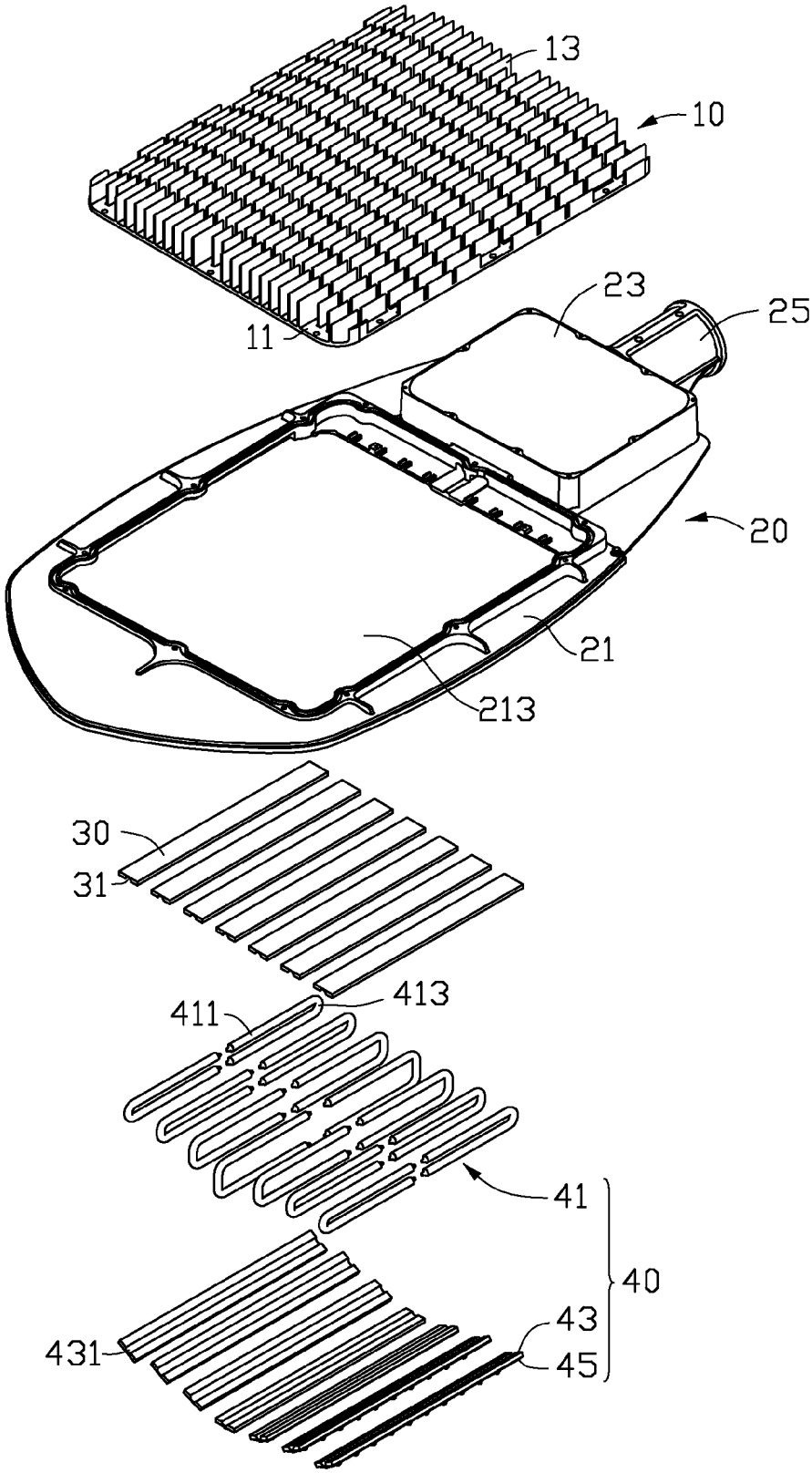
FIG. 2 is an exploded view of FIG. 1.

Referring to FIGS. 1-2, an LED lamp comprises a bracket 20, a heat sink 10 mounted on a top side of the bracket 20, a plurality of heat conductive plates 30 mounted on a bottom of the heat sink 10, and a plurality of LED module assemblies 40 connecting with the heat conductive plates 30 and located at a bottom side of the bracket 20.

Figure 3:
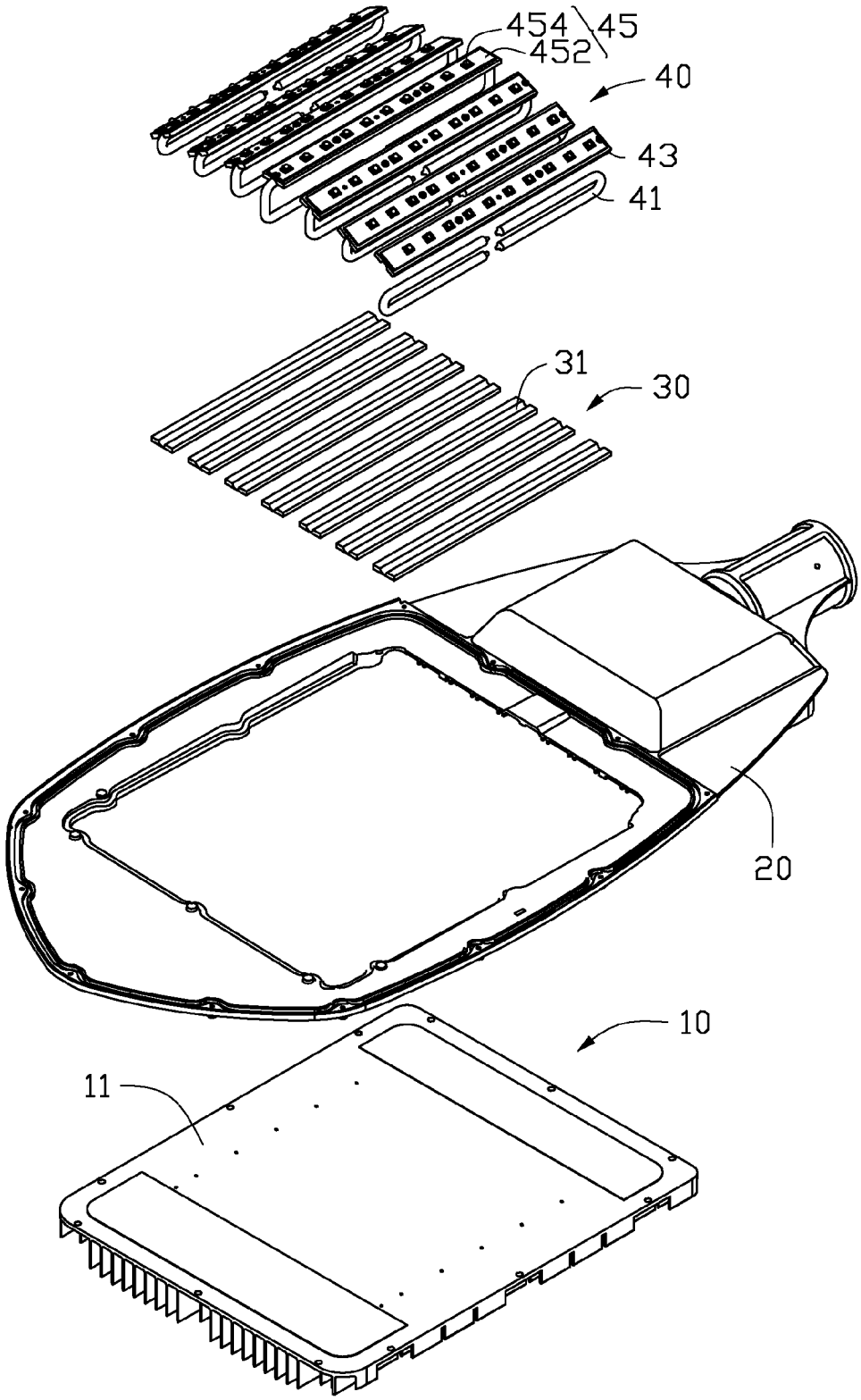
FIG. 3 is an inverted view of FIG. 2.

Referring to FIG. 3 also, the bracket 20 comprises a frame 21 and a driving circuit module 23 located at a right end of the frame 21 to electronically connect with the LED module assemblies 40. The frame 21 has a substantially remiform configuration and defines a rectangular opening 213 at a center therein. A plurality of arc-shaped flanges (not labeled) surrounds the opening 213. A fixture 25 extends rightwards from a center of a right end of the driving circuit module 23. The fixture 25 is used for connecting the LED lamp to a supporting structure, such as a supporting post (not shown) of a lamp stand (not shown).

The heat sink 10 is made of a material with a high degree of heat conductivity, such as copper or aluminum. The heat sink 10 comprises a rectangular base 11 and a plurality of fins 13 extending upwardly from a top surface of the base 11. The base 11 is mounted on the frame 21 and covers the opening 213 of the frame 21.

The heat conductive plates 30 are mounted on a bottom surface of the base 11 of the heat sink 10 and spaced from each other. The heat conductive plates 30 are symmetrical about a central line (not shown) of the bottom surface of the base 11, which is longitudinally extended through a center of the bottom surface of the base 11. Each of the heat conductive plates 30 is a rectangular metal plate. A center of a bottom surface of the heat conductive plate 30 defines an elongated groove 31 to engage with a corresponding LED module assembly 40.

Figure 4:
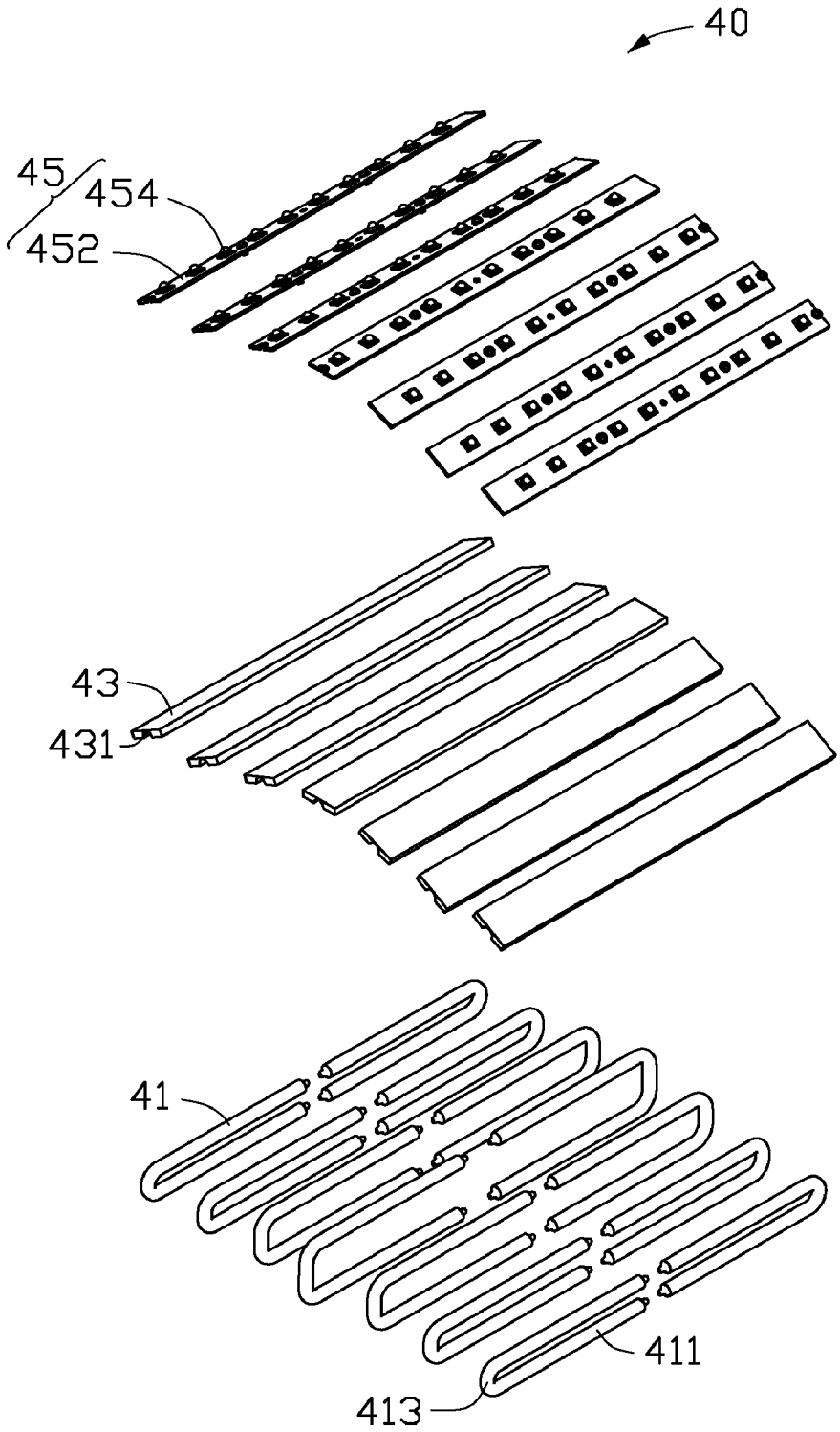
FIG. 4 is an exploded view of an LED module assembly of FIG. 3.

Referring to FIG. 4 also, each LED module assembly 40 comprises an elongated heat absorbing plate 43 located below the heat conductive plate 30, an LED module 45 mounted on a bottom surface of the heat absorbing plate 43 and a pair of heat pipes 41 secured between a top surface of the heat absorbing plate 43 and a bottom surface of the heat conductive plate 30. The heat pipes 41 are sandwiched between the heat conductive plate 30 and the heat absorbing plate 40 and connect with the heat conductive plate 30 and the heat absorbing plate 40.

The heat pipes 41 of a corresponding LED module assembly 40 are symmetrical about a central line (not shown) of the heat absorbing plate 43, which is transversely extended through a center of the heat absorbing plate 43. Each heat pipe 41 has a U-shaped configuration and is horizontally positioned. The heat pipe 41 comprises a pair of parallel, spaced heat conductive portions 411 and a connecting portion 413 interconnecting the heat conductive portions 411. One of the heat conductive portions 411 is received in the groove 31 defined in the bottom surface of the heat conductive plate 30, and another one of the heat conductive portions 411 is secured on the top surface of the heat absorbing plate 43. The connecting portions 413 of the heat pipes 41 of a corresponding LED module assembly 40 are located at lateral sides of the heat conductive plate 30, respectively. The heat conductive portions 411 of the heat pipes 41 of the LED module assemblies 40 have lengths equal to each other. Heights of the connecting portions 413 of the heat pipes 41 of the LED module assemblies 40 are gradually decreased along directions from a central one of the connecting portions 413 toward lateral ones of the connecting portions 413. Therefore, after assembly, the LED modules 45 are at different levels and spaced from the base 11 of the heat sink 10 with different distances. Furthermore, the LED modules 45 are oriented to different directions, wherein a central one of the LED modules 45 is oriented vertically downwards and lateral ones thereof are oriented both downwards and laterally, whereby the LED lamp according to the present invention can have a large range of illumination.

Each of the heat absorbing plates 43 is a rectangular metal plate. The top surface of the heat absorbing plate 43 defines an elongated groove 431 therein, to engagingly receive a lower heat conductive portion 411 of the heat pipe 41. The central heat absorbing plate 43 is parallel to the central heat conductive plate 30 and each of the other heat absorbing plates 43 is inclined at an angle in respect to a corresponding heat conductive plate 30. The angles between the heat absorbing plates 43 and the heat conductive plates 30 are gradually increased from a center toward lateral sides of the heat sink 10. Thus, the LED lamp has a larger illumination angle than the conventional LED lamp.

Each LED module 45 comprises an elongated printed circuit board 452 and a plurality of spaced LEDs 454 evenly mounted on a bottom side of the printed circuit board 452. The LEDs 454 of each LED module 45 are arranged along a longitudinal direction of the printed circuit board 452. Each LED module 45 is mounted in a thermally conductive relationship with a corresponding heat absorbing plate 43.

Heat generated by the LEDs 454 is absorbed by the heat absorbing plates 43, from which the heat is transferred to the heat conductive plates 30 via the heat pipes 41. Finally, the heat is dissipated to surrounding air through the fins 13 of the heat sink 10. Thus, heat of the LED lamp can be effectively and timely dissipated, and the LED lamp can work within a normal temperature range.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a bracket;

a heat sink mounted on a top side of the bracket and comprising a base; and a plurality of LED module assemblies mounted on a bottom surface of the base of the heat sink, each of the LED module assemblies comprising a heat absorbing plate located below a bottom surface of the base of the heat sink, an LED module mounted on a bottom surface of the heat absorbing plate and a heat pipe interconnecting the bottom surface of the base and a top surface of the heat absorbing plate;

wherein the bracket comprises a frame and a driving circuit module located at an end of the frame, the heat sink being mounted on a top side of the frame.

2. The LED lamp as claimed in claim 1, wherein the top surfaces of the heat absorbing plates are angled with the bottom surface of the base, and the angles are gradually increased from a center of the bottom surface of the base toward lateral sides of the bottom surface of the base.

3. The LED lamp as claimed in claim 1, wherein the LED module assemblies are spaced from each other and symmetrical about a central line of the bottom surface of the base, which is longitudinally extended through the center of the bottom surface of the base.

4. The LED lamp as claimed in claim 3, wherein the heat pipes have heights different from each other.

5. The LED lamp as claimed in claim 4, wherein the heat pipe has a U-shaped configuration and comprises a pair of heat conductive portions and a connecting portion interconnecting with the heat conductive portions, the heat conductive portions connecting with the bottom surface of the base and the top surface of the heat absorbing plate respectively.

6. The LED lamp as claimed in claim 5, wherein heights of the connecting portions of the heat pipes of the LED module assemblies are gradually decreased along directions from a central one of the heat pipes toward lateral ones of the heat pipes.

7. The LED lamp as claimed in claim 5, wherein the heat conductive portions of the heat pipes of the LED module assemblies have lengths equal to each other.

8. The LED lamp as claimed in claim 1 further comprising a plurality of heat conductive plates mounted on the bottom surface of the base of the heat sink, the LED module assemblies connecting with the heat conductive plates respectively.

9. The LED lamp as claimed in claim 1, wherein a plurality of fins extends upwardly from a top surface of the base.

10. The LED lamp as claimed in claim 1, wherein the frame has a substantially remiform configuration and defines a rectangular opening at a center thereof, the base of the heat sink being mounted on the frame and covering the opening of the frame.

11. An LED lamp comprising:

a bracket;

a heat sink mounted on the bracket and having a plurality of upwardly extended fins and a bottom surface;

a plurality of LED module assemblies mounted to the bottom surface of the heat sink, each LED module assembly having an LED module and a heat pipe mechanically and thermally interconnecting the LED module and the bottom surface of the heat sink, wherein the LED modules are oriented downwardly towards different directions and spaced from the bottom surface of the heat sink with different distances; and a plurality of heat conductive plates attached to the bottom surface of the heat sink, wherein the heat pipe thermally and mechanically interconnects the LED module and a corresponding heat conductive plate.

12. The LED lamp as claimed in claim 11, wherein a central one of the LED modules is oriented vertically downwards and lateral ones of the LED modules are oriented downwards and laterally.

13. The LED lamp as claimed in claim 12, wherein the heat pipe has a U-shaped configuration and is horizontally positioned, with two parallel conductive portions thermally and mechanically connecting with the LED module and the corresponding heat conductive plate and a connecting portion and interconnecting the conductive portions, the connecting portions of the heat pipes having different heights.

14. The LED lamp as claimed in claim 13, where the central one of the LED modules is parallel with a corresponding one of the heat conductive plates and the lateral ones of the LED modules are inclined with angles in respect to corresponding ones of the heat conductive plates, and the angles are gradually increased along a directions from a center of the bottom surface of the heat sink toward lateral sides thereof.

15. An LED lamp comprising:

a bracket;

a heat sink mounted on a top side of the bracket and comprising a base; and a plurality of LED module assemblies mounted on a bottom surface of the base of the heat sink, each of the LED module assemblies comprising a heat absorbing plate located below a bottom surface of the base of the heat sink, an LED module mounted on a bottom surface of the heat absorbing plate and a heat pipe interconnecting the bottom surface of the base and a top surface of the heat absorbing plate;

wherein the LED module assemblies are spaced from each other and symmetrical about a central line of the bottom surface of the base, which is longitudinally extended through the center of the bottom surface of the base; and wherein the heat pipes have heights different from each other.

16. The LED lamp as claimed in claim 15, wherein the heat pipe has a U-shaped configuration and comprises a pair of heat conductive portions and a connecting portion interconnecting with the heat conductive portions, the heat conductive portions connecting with the bottom surface of the base and the top surface of the heat absorbing plate respectively.

17. The LED lamp as claimed in claim 16, wherein heights of the connecting portions of the heat pipes of the LED module assemblies are gradually decreased along directions from a central one of the heat pipes toward lateral ones of the heat pipes.

18. The LED lamp as claimed in claim 16, wherein the heat conductive portions of the heat pipes of the LED module assemblies have lengths equal to each other.

* * * * *